US006338484B1

(12) United States Patent
Puranen et al.

(10) Patent No.: US 6,338,484 B1
(45) Date of Patent: Jan. 15, 2002

(54) SORTING APPARATUS

(75) Inventors: Jussi Puranen; Petteri Skofelt; Kari Sintonen, all of Lahti (FI)

(73) Assignee: Raute Oyj, Nastola (FI)

( * ) Notice: Subject to any disclaimer, the term of this patent is extended or adjusted under 35 U.S.C. 154(b) by 0 days.

(21) Appl. No.: 09/619,635

(22) Filed: Jul. 19, 2000

(30) Foreign Application Priority Data

Jul. 19, 1999 (FI) ..... 991621

(51) Int. Cl.[7] ..... B65H 39/10
(52) U.S. Cl. ..... 271/303
(58) Field of Search ..... 271/303, 302, 271/307, 304

(56) References Cited

U.S. PATENT DOCUMENTS 4,681,002 A 7/1987 Nakaya ..... 83/71
5,427,368 A 6/1995 Abe et al. ..... 271/283
6,176,485 B1 * 1/2001 Wingate ..... 271/303

* cited by examiner

*Primary Examiner*—David H. Bollinger
(74) *Attorney, Agent, or Firm*—Connolly Bove Lodge & Hutz LLP

(57) ABSTRACT

An apparatus for controlled sorting of sheet-like objects such as veneer sheets in a desired manner onto different paths of travel includes a transport conveyor formed by parallel-traveling, spaced-apart moving transport conveyor elements, such as belts, and further includes a deflecting conveyor traveling locally at least over a certain distance substantially parallel to the transport conveyor. Operating in conjunction with the transport conveyor, rotary elements are adapted so that, in a controlled manner, they can reach upward via the gaps arranged between the transport conveyor elements to lift the veneer sheets. The rotary elements are elevated so as to rest against the deflecting conveyor, and are simultaneously movable in a direction synchronized to the movement of the deflecting conveyor.

9 Claims, 1 Drawing Sheet

SORTING APPARATUS

The present invention relates to an apparatus for controlled sorting by way of deflection of sheet-like objects such as veneer sheets in a desired manner in a continuous train of sheets from one transport conveyor of said sheets to another conveyor. The need for this kind of apparatus occurs, e.g., in the manufacture of plywood when veneer of different grade must be sorted into respective stacks or to a separate post-processing step.

Deflection of a veneer sheet is conventionally based on information obtained from the sheet by means of a suitable monitoring system located on the travel path of the sheets. Next on the sheet travel path, there are located apparatuses that on the basis of this information can deflect the sheet from one path to another. The deflecting apparatuses are adapted to cooperate with the conveyor types used and are based on different kinds of picking, lifting and pressing means that momentarily can be actuated into their working positions. These deflecting means have in common that they are, when actuated, stationary in respect of the travel of the moving sheets. Obviously, this causes a stop in the travel of the sheet to be deflected. As known in the art, attempts have been made to minimize the disadvantages of the stopping deflection step by virtue of arranging the deflection step to occur at a maximized speed.

In the apparatus according to the invention, the stopping effect imposed on the sheet to be deflected by the deflecting means or apparatus is entirely eliminated during the sorting of veneer sheets in a desired manner onto different travel paths. The apparatus includes a sheet-moving transport conveyor comprising parallel-travelling, spaced-apart moving transport conveyor elements such as belts, and a deflecting conveyor travelling locally at least over a certain distance substantially in the same direction with the first conveyor. The transport conveyor has thereto adapted lifting means that in a controlled manner can reach above the transport level of the transport conveyor via the gaps arranged between said conveyor elements, said lifting means being arranged to be elevated into an abutting position against the deflecting conveyor and simultaneously coinciding with the movement of the latter conveyor.

In the following, the invention will be examined in greater detail by making reference to the attached drawing illustrating an exemplifying embodiment, wherein FIG. 1 shows the principal parts of the apparatus in the home position of the apparatus function;

Figure 1:
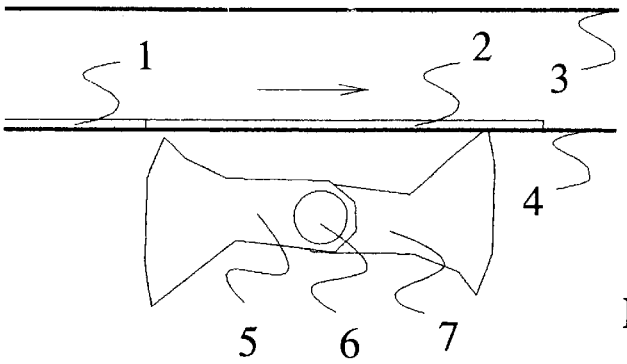
Figure 2:
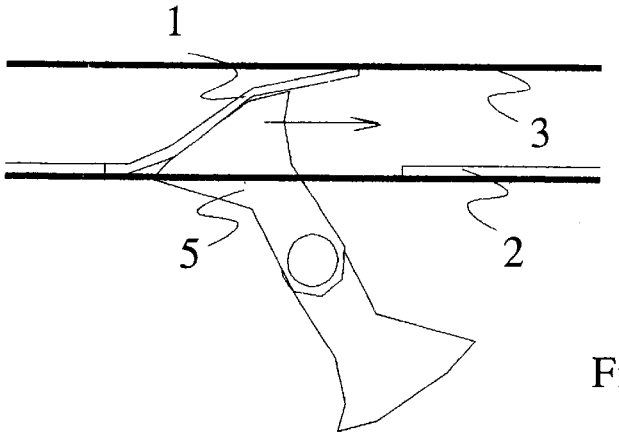
FIG. 2 shows the apparatus in a working position.
Figure 3:
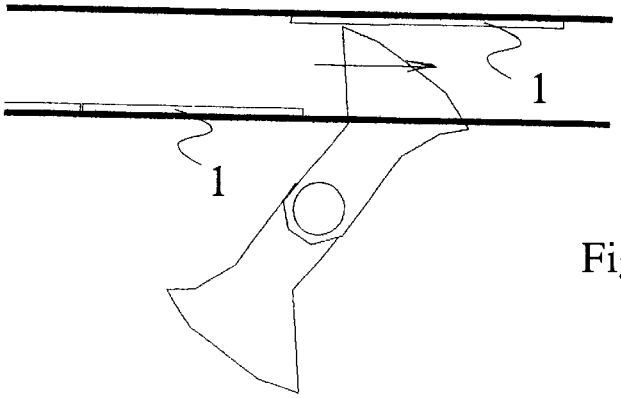
FIG. 3 shows the apparatus in a position where the working function is completed.

The apparatus illustrated in the diagrams comprises a conveyor 4 serving as a transport conveyor for fetching veneer sheets, e.g., from a clipper following a veneer lathe. This conveyor may consist of a plurality of parallel-operating belts or the like transport conveyor elements on which the veneer sheets being transported can travel. In a prior stage of the transport operation, the veneer sheets have been graded, e.g., by their size and/or quality properties on the basis of which selected sheets from a lot are desired to be deflected onto different travel paths.

For this purpose, the apparatus includes a second conveyor 3 serving as a deflecting conveyor. In the illustrated embodiment, the deflecting conveyor is adapted to travel above the transport conveyor 4, parallel thereto. The type of the deflecting conveyor in the exemplifying embodiment may be, e.g., a stick-and-carry conveyor or a vacuum conveyor that with its downward oriented transport means can support and convey forward a veneer sheet lifted in a close proximity to the conveyor surface. Advantageously, the deflecting conveyor is adapted to travel at the same speed with the transport conveyor 4.

According to the invention, there are adapted lifting means 5, 6, 7 to cooperate with the transport conveyor 4, said lifting means being capable of reaching in a controlled manner above the transport level of the transport conveyor 4 so as to meet the underside of the deflecting conveyor 3. The lifting means are implemented as rotary elements having the direction and speed of their motion arranged to cooperate in synchronism with the transport movement of the deflecting conveyor 3. By virtue of this arrangement, a veneer sheet 1 travelling on the transport conveyor 4 can be elevated with the help of the lifting means 5 or 7 off from the first conveyor by controlling said lifting means to rotate about its shaft 6, whereby said means elevates the sheet into a contact with the surface of the deflecting conveyor 3. As the movement of the lifting means is adapted to occur synchronized with the movement of the deflecting conveyor 3, the veneer sheet will smoothly bend upward for being conveyed by this conveyor. To adhere the sheet 1 to the deflecting conveyor, it may be pressed against the nails projecting downward from the underside of the deflecting conveyor 3 or, alternatively, the sheet may be elevated into the effective region of suction when the conveyor 3 is implemented as a vacuum conveyor. Advantageously, the speed of the transport conveyor 4 is also synchronized to the speed of the deflecting conveyor 3 and the tangential speed of the rotary movement of the sheet-lifting means, thus eliminating all possible causes related to the sheet deflection actions that could disturb the continuous travel of the veneer sheets.

What is claimed is:

1. An apparatus for controlled sorting of sheet-like objects including veneer sheets in a desired manner onto different paths of travel, said apparatus comprising:

a transport conveyor, said transport conveyor being formed by parallel-traveling, spaced-apart moving transport conveyor elements including a plurality of belts having free gaps therebetween; and a deflecting conveyor traveling locally at least over a distance in a travel direction which is substantially parallel to said transport conveyor, wherein said transport conveyor has thereto adapted a lifting means that, in a controlled manner, extends above a transport level of said transport conveyor via the free gaps between said moving transport conveyor elements, said lifting means deflecting said veneer sheet from a position on said transport conveyor to an elevated abutting position against the deflecting conveyor parallel to said transport conveyor, wherein said lifting means is simultaneously moved coincident with the movement of the deflecting conveyor.

2. Apparatus according to claim 1, wherein the lifting means comprises at least one lifting element having a peripheral shape substantially similar to a circular segment and adapted to be rotatable about a shaft aligned orthogonally to the travel direction of the transport conveyor.

3. Apparatus according to claim 2, wherein the deflecting conveyor is an adhering type of conveyor of either a stick-and-carry type conveyor or a vacuum type conveyor adapted to operate above the transport conveyor.

4. Apparatus according to claim 1, wherein the deflecting conveyor is an adhering type of conveyor adapted to operate above the transport conveyor.

5. The apparatus of claim 1, wherein the deflecting conveyor is a stick-and-carry type conveyor adapted to operate above the transport conveyor.

6. The apparatus of claim 1, wherein the deflecting conveyor is a vacuum conveyor adapted to operate above the transport conveyor.

7. An apparatus for controlled sorting of sheet-like objects including veneer sheets in a desired manner onto different paths of travel, said apparatus comprising:

a transport conveyor, said transport conveyor being formed by parallel-traveling, spaced-apart moving transport conveyor elements including a plurality of belts having free gaps therebetween; and a deflecting conveyor traveling locally at least over a distance in a travel direction which is substantially parallel to said transport conveyor, wherein said transport conveyor has thereto adapted a lifting means comprising at least one lifting element having a peripheral shape substantially similar to a circular segment and adapted to be rotatable about a shaft aligned orthogonally to a travel direction of the transport conveyor, wherein said at least one lifting element, in a controlled manner, reaches above a transport level of said transport conveyor via the free gaps between said moving transport conveyor elements, said lifting means deflecting said veneer sheet by being arranged to be elevated into an abutting position against the deflecting conveyor, wherein said lifting means is simultaneously moved coincident with the movement of the deflecting conveyor.

8. An apparatus according to claim 7, wherein the deflecting conveyor is an adhering type of conveyor adapted to operate above the transport conveyor.

9. An apparatus for controlled sorting of sheet-like objects including veneer sheets in a desired manner onto different paths of travel, said apparatus comprising:

a transport conveyor, said transport conveyor being formed by parallel-traveling, spaced-apart moving transport conveyor elements including a plurality of belts having free gaps therebetween; and a deflecting conveyor traveling locally at least over a distance in a travel direction which is substantially parallel to said transport conveyor, wherein the deflecting conveyor is an adhering type of conveyor of either a stick-and-carry conveyor type or a vacuum conveyor type adapted to operate above the transport conveyor, wherein said transport conveyor has thereto adapted a lifting means that, in a controlled manner, reaches above a transport level of said transport conveyor via the free gaps between said moving transport conveyor elements, said lifting means deflecting said veneer sheet by being arranged to be elevated into an abutting position against the deflecting conveyor, wherein said lifting means is simultaneously moved coincident with the movement of the deflecting conveyor.

* * * * *